US012673756B2

(12) United States Patent
Wang et al.

(10) Patent No.: US 12,673,756 B2
(45) Date of Patent: Jul. 7, 2026

(54) WATER SURFACE FOLDABLE EMERGENCY-BUILT RUNWAY

(71) Applicant: BEIJING INSTITUTE OF SPACE LAUNCH TECHNOLOGY, Beijing (CN)

(72) Inventors: Bo Wang, Beijing (CN); Xiangxin Liu, Beijing (CN); Lan Li, Beijing (CN); Chengzan Li, Beijing (CN); Yao Li, Beijing (CN)

( * ) Notice: Subject to any disclaimer, the term of this patent is extended or adjusted under 35 U.S.C. 154(b) by 645 days.

(21) Appl. No.: 18/003,985

(22) PCT Filed: Sep. 14, 2022

(86) PCT No.: PCT/CN2022/118619
§ 371 (c)(1),
(2) Date: Dec. 30, 2022

(87) PCT Pub. No.: WO2023/071573
PCT Pub. Date: May 4, 2023

(65) Prior Publication Data

US 2024/0092461 A1 Mar. 21, 2024

(30) Foreign Application Priority Data

Oct. 25, 2021 (CN) ..... 202111238494.3

(51) Int. Cl.

| | |
|---|---|
| ***B63B 35/53*** | (2006.01) |
| ***B63B 7/08*** | (2020.01) |
| ***B63B 21/50*** | (2006.01) |
| ***B63B 79/10*** | (2020.01) |

(52) U.S. Cl.
CPC ..... *B63B 35/53* (2013.01); *B63B 7/08* (2013.01); *B63B 21/50* (2013.01); *B63B 79/10* (2020.01)

(58) Field of Classification Search
CPC ..... B63B 35/53; B63B 35/50; B64U 70/30
See application file for complete search history.

(56) References Cited

U.S. PATENT DOCUMENTS 2,342,773 A * 2/1944 Wellman ..... B63B 35/50 244/114 R
3,771,484 A * 11/1973 Schott ..... B63B 35/50 114/265

(Continued)

*Primary Examiner* — Eldon T Brockman
(74) *Attorney, Agent, or Firm* — Novoclaims Patent Services LLC; Mei Lin Wong

(57) ABSTRACT

The present disclosure relates to a water surface foldable emergency-built runway, including a storage box; a folding runway having an unfolding state and a folding state; a recovery apparatus, being provided in the storage box and connected with the folding runway to push the folding runway out of the storage box or recover into the storage box; a contractile apparatus, being provided on the folding runway to assist the folding runway to be unfolded or folded; an inflation and deflation apparatus, being provided in the storage box and communicated with the interior of the folding runway to inflate or deflate the folding runway; and an anchoring apparatus, being provided at a bottom face of the folding runway to fix the folding runway in water. It has advantages of low cost, convenient transportation, short construction time, strong overturning resistance, compression resistance and flex resistance.

9 Claims, 2 Drawing Sheets

(56) References Cited

U.S. PATENT DOCUMENTS

| | | | | |
|---|---|---|---|---|
| 3,999,879 | A * | 12/1976 | Stachiw | E01D 15/20<br>14/27 |
| 8,038,097 | B1 * | 10/2011 | Monson | B64F 1/027<br>244/110 E |
| 10,363,858 | B1 * | 7/2019 | Woodall | B63C 1/04 |

* cited by examiner

WATER SURFACE FOLDABLE EMERGENCY-BUILT RUNWAY

The present disclosure claims the priority to the application filed by the applicant with Application No. CN2021112384943 entitled "WATER SURFACE FOLDABLE EMERGENCY-BUILT RUNWAY" filed on Oct. 25, 2021. The entire content of the aforementioned application is incorporated herein by overall reference.

TECHNICAL FIELD

The present disclosure relates to the technical field of emergency-built aircraft runways, and in particular to a water surface foldable emergency-built runway.

BACKGROUND

The water surface runway is an important basic technical support for the aircraft to take off and land on the water surface. The traditional water surface runway and emergency-built runway generally have the following problems: the traditional water surface runway is provided as a fixed facility, and a location is fixed, so deployment and recovery cannot be completed quickly as required; the traditional water surface runway has high cost, long construction period, huge system, and complex functions; the traditional water surface runway usually needs to be constructed relying on a seaboard, so it cannot meet takeoff and landing conditions of the aircraft under offshore conditions; there are many applications and research foundations in the field of land emergency-built runway, and because metal materials with large deadweight are used to provide high flatness for the aircraft to take off and land on, when they are applied to the water surface, they need to provide great buoyancy for the emergency-built runway to support its deadweight, so they cannot be directly used on the water surface; and a ship based water surface runway is one of important functions of an aircraft carrier, but the method requires that the aircraft carrier has a higher speed, and the speed of the ship cannot be compared with the flight speed, so in order to provide the emergency-built runway through the aircraft carrier, the aircraft carrier needs to arrive at the destination in advance.

SUMMARY

The present disclosure aims to provide a water surface foldable emergency-built runway, which has advantages of low cost, small space occupation, convenient transportation, short construction time, and strong overturning resistance, compression resistance and flex resistance.

In order to solve the above problems in the prior art, the present disclosure provides a water surface foldable emergency-built runway, including a storage box, and further including:

- a folding runway, being made of a light flexible material, and having an internal filling gas to carry an unfolding state of an aircraft and a folding state when the interior is in vacuum;
- a recovery apparatus, being provided in the storage box and connected with the folding runway to push the folding runway out of the storage box when it is necessary to be unfolded, and then recover the folding runway into the storage box after being folded;
- a contractile apparatus, being provided on the folding runway to assist the folding runway to be unfolded and folded;

- an inflation and deflation apparatus, being provided in the storage box, sealed with the folding runway through a pipeline, and communicated with the interior of the folding runway to inflate the folding runway when it is unfolded, and deflate the folding runway when it is folded; and
- an anchoring apparatus, being provided at a bottom face of the folding runway to fix the unfolded folding runway in water.

Further, the water surface foldable emergency-built runway according to the present disclosure, further including:

- an attitude monitoring system, being provided on the folding runway to monitor status data of the folding runway itself and hydrological information of a location around the folding runway; and
- an attitude control system, being electrically connected with the recovery apparatus, the contractile apparatus, the inflation and deflation apparatus and the anchoring apparatus, respectively, to control the recovery apparatus, the contractile apparatus, the inflation and deflation apparatus and the anchoring apparatus to complete a corresponding action according to a corresponding control command.

Furthermore, the water surface foldable emergency-built runway according to the present disclosure, where the folding runway includes an external anti-skid drainage layer and an internal reinforcement layer, the external anti-skid drainage layer and the internal reinforcement layer are bonded by an adhesive manner, and the external anti-skid drainage layer and the internal reinforcement layer form a confined space and an unfolded shape of the folding runway after being inflated is defined by wire drawing Further, the water surface foldable emergency-built runway according to the present disclosure, where the recovery apparatus includes at least one first telescopic component, a fixed end of the first telescopic component is fixedly connected with the storage box, and an active end of the first telescopic component is connected with the folding runway.

Further, the water surface foldable emergency-built runway according to the present disclosure, where the contractile apparatus includes a plurality of second telescopic components and a plurality of third telescopic components, the plurality of second telescopic components are provided on the folding runway at intervals between each other, and the plurality of third telescopic components are provided between the two adjacent second telescopic components at intervals between each other.

Further, the water surface foldable emergency-built runway according to the present disclosure, where the active end of the first telescopic component is connected with the folding runway through the second telescopic component close to the storage box.

Further, the water surface foldable emergency-built runway according to the present disclosure, where the inflation and deflation apparatus includes an inflation apparatus, an evacuation apparatus, an inflation valve and an exhaust valve, the inflation apparatus is communicated with the interior of the folding runway through an inflation pipeline, the inflation valve is mounted on the inflation pipeline, the evacuation apparatus is connected with one end of the exhaust valve through an exhaust pipeline, and the other end of the exhaust valve is connected with the inflation pipeline.

Further, the water surface foldable emergency-built runway according to the present disclosure, where the anchoring apparatus includes an anchor chain recovery and launch apparatus, an anchor chain and an anchor, one end of the anchor chain is connected with the anchor chain recovery and launch apparatus, and the other end of the anchor chain is fixedly connected with the anchor; when the folding runway is in the folding state, the anchor chain is in a recovery state, and when the folding runway is in the unfolding state, the anchor chain is in a launch state.

Furthermore, the water surface foldable emergency-built runway according to the present disclosure, where the anchoring apparatus is provided in a plurality.

Furthermore, the water surface foldable emergency-built runway according to the present disclosure, where the attitude monitoring system includes a sensor, the sensor is provided on the folding runway, and the sensor is electrically connected with the attitude control system.

Compared with the prior art, the water surface foldable emergency-built runway according to the present disclosure has the following advantages: when it is not necessary to be used, all components are placed in the storage box, which takes up less space, and is convenient for storage and transportation, and when it is necessary to be used, it can be put into the designated position of designated waters by an aircraft or ship according to the actual requirements, and the folding runway can be pushed out of the storage box by the recovery apparatus; at the same time, the folding runway is unfolded by the contractile apparatus and inflation and deflation apparatus, and construction of a runway on water can be completed after the folding runway is fully unfolded and fixed by the anchoring apparatus, so that the folding runway can be quickly unfolded to shorten construction time, and the folding runway is made of a light flexible inflatable material, which has strong compression resistance and flex resistance, and can be a takeoff and landing runway of a fixed-wing aircraft or helicopter; and compared with the existing water surface runway, the present disclosure has lower cost, does not need to be constructed for a long time, and does not rely on the ship, so it is more suitable for use as an emergency-built equipment; at the same time, it also has strong overturning resistance, and can be used as a temporary berth for an emergency rescue personnel or small ship in extreme weather conditions.

The further effects of the above non-conventional embodiments will be described below in combination with the specific embodiments.

BRIEF DESCRIPTION OF THE DRAWINGS

In order to more clearly describe embodiments of the present disclosure or existing technical solution, the following will briefly introduce the drawings needed in the description of the embodiments or prior art. Obviously, the drawings in the following description are merely some embodiments recorded in the present disclosure. For those of ordinal skilled in the art, other drawings may also be acquired according to the drawings without paying creative labor.

DETAILED DESCRIPTION

Figure 1:
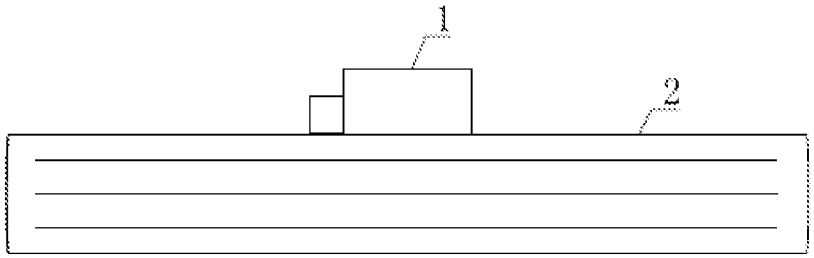
FIG. 1 is a top view structural diagram of a water surface foldable emergency-built runway according to the present disclosure.

Illustrative embodiments will be described in detail here, and examples thereof are shown in the drawings. When the following description refers to the drawings, unless otherwise indicated, the same number in different drawings indicates the same or similar elements. The embodiments described in the following illustrative embodiments do not represent all embodiments consistent with the present disclosure. On the contrary, they are merely examples of apparatuses and methods consistent with some aspects of the present disclosure as detailed in the appended claims.

The terms used in the present disclosure are merely for the purpose of describing the specific embodiments, and are not intended to limit the present disclosure. The singular forms of "one", "said" and "the" used in the present disclosure and the appended claims are also intended to include the majority forms, unless the context clearly indicates other meanings. It should also be understood that the term "and/or" used herein refers to and include any or all possible combinations of one or more associated listed items.

It should be understood that although the terms first, second, third and the like may be used to describe various information in the present disclosure, such information should not be limited to the terms. The terms are merely used to distinguish the same type of information from each other. For example, without departing from the scope of the present disclosure, a first information may also be called a second information, and similarly, the second information may also be called the first information.

As shown in FIGS. 1-4, the present disclosure provides specific embodiments of a water surface foldable emergency-built runway, including a storage box 1, and further including:

- a folding runway 2, being made of a light flexible material, and having an internal filling gas to carry an unfolding state of an aircraft and a folding state when the interior is in vacuum;
- a recovery apparatus 3, being provided in the storage box 1 and connected with the folding runway 2 to push the folding runway 2 out of the storage box 1 when it is necessary to be unfolded, and then recover the folding runway 2 into the storage box 1 after being folded;
- a contractile apparatus 4, being provided on the folding runway 2 to assist the folding runway 2 to be unfolded and folded;
- an inflation and deflation apparatus 5, being provided in the storage box 1, sealed with the folding runway 2 through a pipeline, and communicated with the interior of the folding runway 2 to inflate the folding runway 2 when it is unfolded, and deflate the folding runway 2 when it is folded; and
- an anchoring apparatus 6, being provided at a bottom face of the folding runway 2 to fix the unfolded folding runway 2 in water.

In practical applications, when it is not necessary to be used, all components are placed in the storage box 1, which takes up less space, and is convenient for storage and transportation, and when it is necessary to be used, it can be put into the designated position of designated waters by an aircraft or ship according to the actual requirements, and the folding runway 2 can be pushed out of the storage box 1 by the recovery apparatus 3; at the same time, the folding runway 2 is unfolded by the contractile apparatus 4 and inflation and deflation apparatus 5, and construction of a runway on water can be completed after the folding runway 2 is fully unfolded and fixed by the anchoring apparatus 6, so that the folding runway 2 can be quickly unfolded to shorten construction time, and the folding runway 2 is made of a light flexible inflatable material, which has strong compression resistance and flex resistance, and can be a takeoff and landing runway of a fixed-wing aircraft or helicopter; and compared with the existing water surface runway, the present disclosure has lower cost, does not need to be constructed for a long time, and does not rely on the ship, so it is more suitable for use as an emergency-built equipment; at the same time, it also has strong overturning resistance, and can be used as a temporary berth for an emergency rescue personnel or small ship in extreme weather conditions.

On the basis of the above embodiments, the present embodiment further includes:

an attitude monitoring system, being provided on the folding runway 2 to monitor status data of the folding runway 2 itself and hydrological information of a location around the folding runway 2; and an attitude control system, being electrically connected with the recovery apparatus 3, the contractile apparatus 4, the inflation and deflation apparatus 5 and the anchoring apparatus 6, respectively, to control the recovery apparatus 3, the contractile apparatus 4, the inflation and deflation apparatus 5 and the anchoring apparatus 6 to complete a corresponding action according to a corresponding control command.

In the present embodiment, an unfolding degree of the attitude monitoring system to the folding runway 2, a pressure that the folding runway 2 may withstand after being inflated, a position of the folding runway 2 in the water, a depth of immersion in the water, a vibration amplitude of the folding runway 2, a wind direction on the water surface and other data can be collected to determine whether aircraft takeoff and landing operations can be met by person. The attitude control system may realize automation of the water surface foldable emergency-built runway, so that the recovery apparatus 3, the contractile apparatus 4, the inflation and deflation apparatus 5 and the anchoring apparatus 6 may act autonomously according to the control command sent by the attitude control system.

Figure 2:
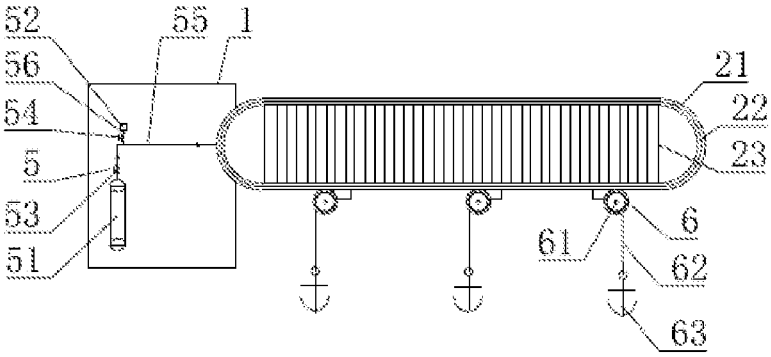
FIG. 2 is an overall structural diagram of a water surface foldable emergency-built runway according to the present disclosure.
Figure 3:
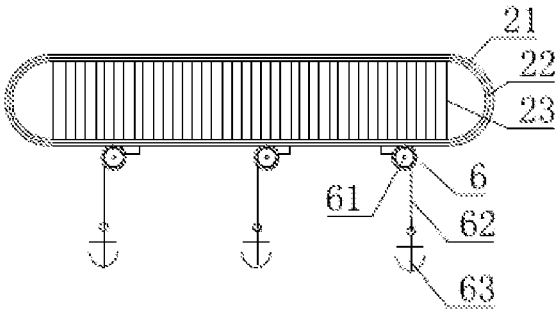
FIG. 3 is a structural diagram of a folding runway section of a water surface foldable emergency-built runway according to the present disclosure.

As shown in FIG. 2 and FIG. 3, the folding runway 2 specifically includes an external anti-skid drainage layer 21 and an internal reinforcement layer 22, the external anti-skid drainage layer 21 and the internal reinforcement layer 22 are bonded by an adhesive manner, and the external anti-skid drainage layer 21 and the internal reinforcement layer 22 further form a confined space and an unfolded shape of the folding runway 2 after being inflated is defined by wire drawing 23 (that is, a confined airbag structure is enclosed by the internal reinforcement layer 22, the external anti-skid drainage layer 21 is bonded to an external surface of the internal reinforcement layer 22, and then connected up and down in series between upper and lower opposite internal reinforcement layers 22 in the confined space formed by the internal reinforcement layer 22 through the dense wire drawing 23, so that the external anti-skid drainage layer 21 and the internal reinforcement layer 22 form an integrated structure like a wire drawing cloth, thereby limiting a final shape of the airbag structure after being inflated, and the wire drawing 23 is in a relaxed state without being inflated, and the internal reinforcement layer 22 will stretch outward according to the established shape under an action of the wire drawing 23 during inflating). The external anti-skid drainage layer 21 may be made of an EVA anti-skid pad, of course, it does not rule out the use of other materials that can achieve a function of drainage and anti-skid. The internal reinforcement layer 22 is made of an ultra-high molecular weight polyethylene fiber reinforced composite membrane material, of course, it does not rule out the use of other materials that can meet the strength required by the folding runway 2. Through the above settings, after the confined space enclosed by the external anti-skid drainage layer 21 and the internal reinforcement layer 22 is inflated, the external anti-skid drainage layer 21 and the internal reinforcement layer 22 expand outward according to the established overall shape under a tension condition of the wire drawing 23, unfold into a runway shape, and float on the water surface. The fully unfolded folding runway 2 has a flat surface, uniform stress distribution; an earth pressure can withstand 3 Mpa, which can meet the takeoff and landing of a light aircraft (such as a small fixed wing aircraft, a helicopter or a unmanned aerial vehicle); it has good air tightness, and one use may ensure a normal use for more than half a year; and it has high tensile strength, high tear strength, more than 10000 times of flex resistance, durability, and has advantages of simple fabrication and low fabrication cost.

Figure 4:
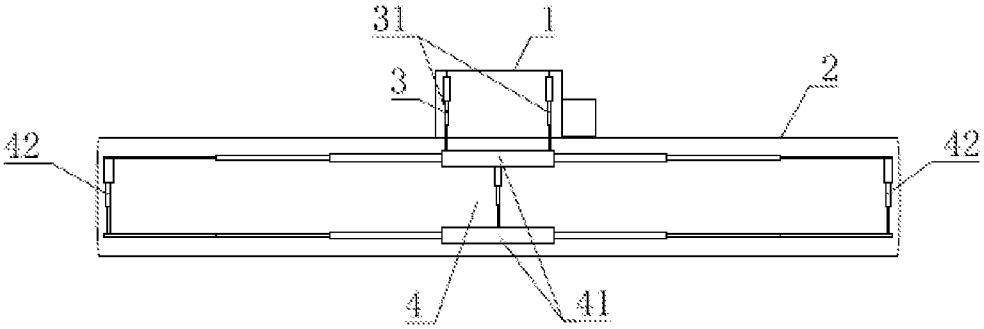
FIG. 4 is a bottom view structural diagram of a water surface foldable emergency-built runway according to the present disclosure.

As shown in FIG. 4, the recovery apparatus 3 specifically includes at least one first telescopic component 31, a fixed end of the first telescopic component 31 is fixedly connected with the storage box 1, and an active end of the first telescopic component 31 is connected with the folding runway 2. The first telescopic component 31 may adopt an existing mechanical telescopic structure or a structure such as a multi-stage air/hydraulic cylinder. In order to stabilize the structure, the first telescopic component 31 may be provided in a plurality. When providing a plurality of first telescopic components 31, the plurality of first telescopic components 31 act synchronously to enhance action consistency and stability thereof. In addition, the first telescopic component 31 can complete a telescopic action according to a control command sent by the attitude control system. When it is necessary to apply the folding runway 2, the attitude control system sends the control command to control the first telescopic component 31 to be launched gently to push the folding runway 2 out of the storage box 1. When it is necessary to recover the folding runway 2, the attitude control system sends the control command to control the first telescopic component 31 to be recovered slowly to bring the folding runway 2 from the outside of the storage box 1 into the storage box 1, so as to improve automation performance thereof.

As shown in FIG. 4, the contractile apparatus 4 specifically includes a plurality of second telescopic components 41 and a plurality of third telescopic components 42, the plurality of second telescopic components 41 are provided on the folding runway 2 at intervals between each other, and the plurality of third telescopic components 42 are provided between the two adjacent second expansion components 41 at intervals between each other. The second telescopic component 41 and the third telescopic component 42 may adopt the existing mechanical telescopic structure or adopt the structure such as the multi-stage air/hydraulic cylinder. Two second telescopic components 41 and three third telescopic components 42 are shown in FIG. 4, of course, the number of second telescopic components 41 and third telescopic components 42 may also be changed according to a size of the folding runway 2. Through the above settings, the second telescopic component 41 may be used to assist the folding runway to complete the folding along its length, and the third telescopic component 42 may be used to assist the folding runway 2 to complete the folding along its width. In addition, the second telescopic component 41 and the third telescopic component 42 can complete the above action according to the control command sent by the attitude control system to improve the automation performance thereof.

As a further improvement, the active end of the first telescopic component 31 is connected with the folding runway 2 through the second telescopic component 41 close to the storage box 1. Through the above setting, the first telescopic component 31, the second telescopic component 41 and the third telescopic component 42 form a whole. When unfolding the folding runway 2, after the first telescopic component 31 is used to complete an unfolding action to push the folding runway 2 out of the storage box 1, the second telescopic component 41 and the third telescopic component 42 are used to perform the unfolding action to unfold the folding runway 2. When folding the folding runway 2, after the second telescopic component 41 and the third telescopic component 42 are used to perform a folding action to fold the folding runway 2, the first telescopic component 31 is used to complete the folding action to recover the folding runway 2 into the storage box 1.

As shown in FIG. 2, the inflation and deflation apparatus specifically includes an inflation apparatus 51, an evacuation apparatus 52, an inflation valve 53 and an exhaust valve 54, the inflation apparatus 51 is communicated with the interior of the folding runway 2 through an inflation pipeline 55, the inflation valve 53 is mounted on the inflation pipeline 55, the evacuation apparatus 52 is connected with one end of the exhaust valve 54 through an exhaust pipeline 56, and the other end of the exhaust valve 54 is connected with the inflation pipeline 55. It can be understood that inflation apparatus 51 may use an inflation device such as an air inflator, the evacuation apparatus 52 may use an evacuation device such as a vacuum air pump, and the inflation valve 53 and the exhaust valve 54 may use a valve such as a solenoid valve. In order to ensure that the folding runway 2 may be pushed out and taken back from the storage box 1, the inflation pipeline 55 connected with the folding runway 2 is designed as a flexible pipeline with high strength. In addition, the inflation apparatus 51 and the evacuation apparatus 52 can start and stop automatically according to the control command sent by the attitude control system, and the inflation valve 53 and the exhaust valve 54 can start and close automatically according to the control command sent by the attitude control system to improve the automation performance thereof.

The first telescopic component 31, the second telescopic component 41 and the third telescopic assembly 42 may also be provided as multistage air cylinders, and the first telescopic component 31, the second telescopic component 41 and the third telescopic component 42 share the inflation apparatus 51, the evacuation apparatus 52, the inflation valve 53 and the exhaust valve 54 with the folding runway 2. During the unfolding operation, the first telescopic component 31, the second telescopic component 41 and the third telescopic component 42 are synchronously stretched while inflating the folding runway 2, thereby shortening an unfolding time of the folding runway 2. During the folding operation, the first telescopic component 31, the second telescopic component 41 and the third telescopic component 42 are synchronously retracted while deflating the folding runway 2, thereby shortening a folding time of the folding runway 2. Therefore, the construction time of folding runway 2 is shortened to win valuable time for a unit using the runway.

As shown in FIG. 2 and FIG. 3, in order to ensure that the folding runway 2 can be more stably fixed on the water surface after being unfolded, the anchoring apparatus 6 is provided in a plurality. The anchoring apparatus 6 specifically includes an anchor chain recovery and launch apparatus 61, an anchor chain 62 and an anchor 63, one end of the anchor chain 62 is connected with the anchor chain recovery and launch apparatus 61, and the other end of the anchor chain 62 is fixedly connected with the anchor 63; when the folding runway 2 is in the folding state, the anchor chain 62 is in a recovery state, and when the folding runway 2 is in the unfolding state, the anchor chain 62 is in a launch state. In practical applications, the anchor chain recovery and launch apparatus 61 is generally fixed and mounted on a bottom face of the folding runway 2 (that is, a side of the folding runway 2 contacting the water surface when it is unfolded). The anchor chain recovery and launch apparatus 61 may adopt a coiler to fix the anchor chain 62 by means of winding. In order to facilitate to disconnect the anchor chain 62 when recovering the folding runway 2, an end of the anchor chain 62 that is not fixed with the anchor 63 may be hung on a bulge provided on a spool of the anchor chain recovery and launch apparatus 61. When fixing the folding runway 2, the anchor chain 62 will reserve a section to be wound on the spool of the anchor chain recovery and launch apparatus 61. When recovering the folding runway 2, the spool of the anchor chain recovery and launch apparatus 61 continues to rotate, and the anchor chain 62 will fall off the bulge of the spool due to its own gravity, so that the folding runway 2 will get rid of bondage of the anchor chain 62. In the next use, the new anchor chain 62 and anchor 63 are replaced so as to be used for the next time.

On the basis of the above embodiments, the attitude monitoring system in the present embodiment specifically includes a sensor, the sensor is provided on the folding runway 2, and the sensor is electrically connected with the attitude control system. The sensor includes a shaft angle encoder, a vibration sensor, a pressure sensor, a liquid level sensor, a wind direction sensor and other sensors. Additional sensors with different functions may be added according to the required functions. The attitude control system includes a data processor, which may perform an analog-to-digital conversion and a corresponding settlement output on the data collected by various sensors, and then send the control command to the recovery apparatus 3, the contractile apparatus 4, the inflation and deflation apparatus 5 and the anchoring apparatus 6. The data processor may adopt a DSP (Digital Signal Processor) digital signal processor, a FPGA (Field Programmable Gate Array) field programmable gate array, a MCU (Microcontroller Unit) system board, a SoC (system on a chip) system board, or a PLC (Programmable Logic Controller) minimum system including I/O.

A specific use process of the present disclosure is as follows. When it is necessary to unfold, the attitude control system sends a command to control the first telescopic component 31 to push the folding runway 2 out of the storage box 1, turn on the inflation valve 53, and turn off the exhaust valve 54. Then a high-pressure gas is injected from the inflation apparatus 51 into the confined space enclosed by the external anti-skid drainage layer 21 and the internal reinforcement layer 22 through the inflation pipeline 55. At the same time, the plurality of second telescopic components 41 and the plurality of third telescopic components 42 are stretched outward to expand the light flexible folding runway 2 outward according to the established overall shape, at the same time it is tensioned through the high-strength wire drawing 23, and after sufficient gas is inflated and a certain pressure is reached, the folding runway 2 is unfolded into a flat shape to float on the water surface. The anchoring apparatus 6 launches a plurality of groups of anchors 63 into the water bottom through the anchor chain recovery and launch apparatus 61 and fix them to constitute the runway, which provides a takeoff and landing runway for the small fixed wing aircraft or helicopter. At the same time, the attitude monitoring system monitors parameters such as hydrological conditions and an internal pressure of folding runway 2 through various sensors.

When it is necessary to recover, the attitude control system sends a command to start the anchoring apparatus 6, disconnect the anchor chain 62 connecting the plurality of groups of anchors 63 through the anchor chain recovery and launch apparatus 61, then turn on the exhaust valve 54 and the evacuation apparatus 52, and turn off the inflation valve 53. The high-pressure gas is deflated from the confined space enclosed by the external anti-skid drainage surface 21 and the internal reinforcement layer 22, while the plurality of second telescopic components 41 and the plurality of third telescopic components 42 contract outward, and after the air in the folding runway 2 is completely deflated, the first telescopic component 31 provided in the storage box 1 is recovered, and the folding runway 2 is recovered into the storage box 1 for storage.

Before the next use, it is only necessary to connect the new anchor 63 and anchor chain 62 with the anchor chain recovery and launch apparatus 61, that is, it can be reused.

The above are merely the embodiments of the present disclosure and are not intended to limit the present disclosure. For those skilled in the art, the present disclosure may have various changes and variations. Any amendments, equivalent alternatives, improvements and the like made within the spirit and principle of the present disclosure shall be included in the scope of claims of the present disclosure.

INDUSTRIAL APPLICABILITY

A water surface foldable emergency-built runway provided by the present disclosure is suitable for use as an emergency-built equipment, which has strong overturning resistance at the same time, and may be used as a temporary berth for an emergency rescue personnel or small ship in extreme weather conditions. The formed product may be mass produced and used in industry.

The invention claimed is:

1. A water surface foldable emergency-built runway, comprising a storage box, and further comprising:

a folding runway, being made of a flexible material and provided in the storage box, and having an unfolding state when an interior is filled with internal filling gas to support an aircraft and a folding state when the interior is in vacuum;

a recovery apparatus, being provided in the storage box and connected with the folding runway to push the folding runway out of the storage box when it is necessary to be unfolded, and then recover the folding runway into the storage box after being folded;

a contractile apparatus, being provided on the folding runway to assist the folding runway to be in the unfolding state and the folding state respectively;

an inflation apparatus and an evacuation apparatus, being provided in the storage box, sealedly connected with the folding runway through a pipeline, wherein the inflation apparatus is mounted on an inflation pipeline and communicated with the interior of the folding runway to inflate the folding runway to the unfolding state through the inflation pipeline, and the evacuation apparatus, arranged to deflate the folding runway to the folding state, is connected with one end of the exhaust valve through an exhaust pipeline, and the other end of the exhaust valve is connected with the inflation pipeline; and an anchor chain recovery and launch coiler, an anchor chain and an anchor, being provided at a bottom face of the folding runway to fix the folding runway in the unfolding state into position in water.

2. The water surface foldable emergency-built runway according to claim 1, further comprising:

a sensor, being provided on the folding runway to monitor status data of the folding runway itself and hydrological information of a location around the folding runway; and a data processor, being electrically connected with the recovery apparatus, the contractile apparatus, the inflation and deflation apparatus and the anchoring apparatus, respectively, to control the recovery apparatus, the contractile apparatus, the inflation and deflation apparatus and the anchoring apparatus to complete a corresponding action according to a corresponding control command.

3. The water surface foldable emergency-built runway according to claim 2, wherein the folding runway comprises an external anti-skid drainage layer and an internal reinforcement layer, the external anti-skid drainage layer and the internal reinforcement layer are bonded by an adhesive, and the external anti-skid drainage layer and the internal reinforcement layer form a confined space and an unfolded shape of the folding runway after being inflated to the unfolding state is defined by wire drawing.

4. The water surface foldable emergency-built runway according to claim 3, wherein the recovery apparatus comprises at least one first telescopic component, a fixed end of the first telescopic component is fixedly connected with the storage box, and an active end of the first telescopic component is connected with the folding runway.

5. The water surface foldable emergency-built runway according to claim 4, wherein the contractile apparatus comprises a plurality of second telescopic components and a plurality of third telescopic components, the plurality of second telescopic components are provided on the folding runway at intervals between each other, and the plurality of third telescopic components are provided between the two adjacent second telescopic components at intervals between each other.

6. The water surface foldable emergency-built runway according to claim 5, wherein the active end of the first telescopic component is connected with the folding runway through the second telescopic component close to the storage box.

7. The water surface foldable emergency-built runway according to claim 1, wherein one end of the anchor chain is connected with the anchor chain recovery and launch coiler, and the other end of the anchor chain is fixedly connected with the anchor; when the folding runway is in the folding state, the anchor chain is in a recovery state, and when the folding runway is in the unfolding state, the anchor chain is in a launch state.

8. The water surface foldable emergency-built runway according to claim 7, wherein the anchoring apparatus is provided in a plurality.

9. The water surface foldable emergency-built runway according to claim 7, wherein the sensor is electrically connected with the data processor.

* * * * *